US007559151B2

(12) United States Patent
Bagley

(10) Patent No.: US 7,559,151 B2
(45) Date of Patent: Jul. 14, 2009

(54) TRANSFER TOOL

(76) Inventor: Mark Bagley, 10000 Creekwater Blvd., Orlando, FL (US) 32825

( * ) Notice: Subject to any disclaimer, the term of this patent is extended or adjusted under 35 U.S.C. 154(b) by 0 days.

(21) Appl. No.: 11/755,151

(22) Filed: May 30, 2007

(65) Prior Publication Data

US 2008/0155849 A1 Jul. 3, 2008

Related U.S. Application Data

(60) Provisional application No. 60/786,986, filed on Oct. 16, 2006.

(51) Int. Cl.
*A41H 1/00* (2006.01)

(52) U.S. Cl. ..... 33/566; 33/12; 33/563

(58) Field of Classification Search ..... 33/11, 33/12, 13, 17 R, 1 B, 1 G, 2 R, 489, 494, 33/562, 563, 565, 566
See application file for complete search history.

(56) References Cited

U.S. PATENT DOCUMENTS

| | | | | | |
|---|---|---|---|---|---|
| 78,325 | A * | 5/1868 | Rand | 33/12 |
| 1,173,301 | A * | 2/1916 | Murphy et al. | 33/12 |
| 2,533,295 | A * | 12/1950 | Starbuck | 33/2 R |
| 4,349,966 | A * | 9/1982 | Marino et al. | 33/489 |
| 4,461,086 | A * | 7/1984 | Segletes | 33/564 |
| 4,490,916 | A * | 1/1985 | Blum | 33/565 |
| 4,490,921 | A * | 1/1985 | Woods et al. | 33/476 |
| 5,386,654 | A * | 2/1995 | Kroenke | 38/141 |
| 5,557,996 | A * | 9/1996 | Reber et al. | 83/56 |
| 5,791,062 | A * | 8/1998 | Walker | 33/563 |
| 6,049,987 | A * | 4/2000 | Robell | 33/1 B |
| 6,216,354 | B1 * | 4/2001 | Carbone | 33/565 |
| 6,935,039 | B1 * | 8/2005 | Hess | 33/562 |
| 7,000,329 | B2 * | 2/2006 | Brady | 33/562 |
| 7,251,898 | B2 * | 8/2007 | Schafer et al. | 33/1 B |
| 2004/0172844 | A1 * | 9/2004 | Murray et al. | 33/563 |
| 2005/0011079 | A1 * | 1/2005 | Sikora et al. | 33/566 |
| 2006/0032068 | A1 * | 2/2006 | Sherman et al. | 33/566 |
| 2007/0261260 | A1 * | 11/2007 | Loza | 33/566 |
| 2008/0078094 | A1 * | 4/2008 | Baumann | 33/566 |

FOREIGN PATENT DOCUMENTS

GB 2245815 A * 1/1992

OTHER PUBLICATIONS

"Tee Square It!", http://www.teesquareit.com, 2 pages, printed from the Internet May 9, 2007.

* cited by examiner

*Primary Examiner*—R. Alexander Smith
(74) *Attorney, Agent, or Firm*—Quick Patents, Inc; Kevin Prince

(57) ABSTRACT

The present device is a guide for positioning a heat-applied item over a garment, such as a t-shirt, or a nonwearable, such as a towel. The guide comprises a substantially flat sheet including a center line indicator, a plurality of longitudinal rule lines, a plurality of lateral rule lines, at least one pair of collar alignment rule lines, two wing sections, and a plurality of sleeve alignment rule lines. The guide includes intersecting longitudinal and lateral slots whereby the heat-applied item may be placed under the guide and positioned relative to the guide and garment by manual manipulation thereof through the slots. Another feature of the guide includes a plurality of vertical offset spacers fixed to the bottom surface of the sheet, such that a gap is formed between the guide and the garment for facilitating movement of the heat-applied item there between.

23 Claims, 2 Drawing Sheets

TRANSFER TOOL

CROSS-REFERENCE TO RELATED APPLICATIONS

This application claims the benefit of U.S. Provisional Patent Application 60/786,986, filed on Oct. 16, 2006, and incorporated herein by reference.

STATEMENT REGARDING FEDERALLY SPONSORED RESEARCH AND DEVELOPMENT

Not Applicable.

FIELD OF THE INVENTION

This invention relates to positioning guides, and more particularly to a positioning guide for aiding in the placement of heat-applied items to a garment or non-wearable item.

BACKGROUND OF THE INVENTION

A need exists for placing designs and indicia on garments and other items such as bags. A common solution for this need is to use heat to fix a design or indicia onto such items. However, many challenges are faced when applying a heat-applied item onto other items. With most garments being larger than the heat press platen, it is extremely difficult to determine whether the garment is straight on a platen. Centering the heat-applied item, such as transfers, numbers or letters, can be difficult and taking measurements can be time consuming. When producing several garments that have multiple heat-applied items, such as athletic jerseys, the spacing between the heat-applied items becomes important due to the fact that these garments may be seen together and it is easy to tell if a heat-applied item is straight compared to other heat-applied items. Most of the time in production, the user is forced to either decide on whether to provide a high quality application that takes longer to produce, or provide a lower quality application in a shorter time.

Therefore, there is a need for a guide that helps center and position heat-applied items to assure the accuracy of the application. Such a needed device would also decrease the amount of time to produce a high quality application. The present invention accomplishes these objectives.

SUMMARY OF THE INVENTION

The present device is a guide for positioning a heat-applied item over a garment. The guide comprises a substantially flat sheet having a top surface, a bottom surface, a front edge, a rear edge, and at least two side edges, the flat sheet including a center line indicator along a longitudinal axis thereof, a plurality of longitudinal rule lines symmetrically positioned on either side of the center line indicator and substantially parallel thereto, and a plurality of lateral rule lines extending between each side edge and evenly spaced between the front and rear edges. With the guide placed over a garment lying flat on a surface, the guide may be moved relative to the garment to position the guide on the garment, the guide indicating proper placement of the heat-applied item on the garment.

In one embodiment, at least one pair of collar alignment rule lines is proximate to the front edge of the guide, substantially parallel to the center line indicator, and symmetrically positioned about the center line indicator. Another embodiment of the guide includes additional pairs of collar alignment rule lines each being distinct in appearance from each adjacent pair of collar alignment rule lines.

One embodiment of the sheet further includes two wing sections projecting from each side of the sheet. A preferred embodiment of the sheet includes rounded corners of the wing sections. The wing sections include a plurality of sleeve alignment rule lines spaced evenly there along and substantially perpendicular to the center line indicator. With the guide positioned on the garment, the garment being a shirt, for example, each of two sleeves of the shirt may be folded over the guide, and an edge of each sleeve may be pulled tight to be aligned with corresponding sleeve alignment rule lines of each wing section, the guide thereby being properly positioned and square on the shirt. On smaller garments the sleeves do not have to fold over the guide. Instead, both sleeves can lay flat on the surface and the sleeves are aligned with corresponding sleeve alignment rule lines by peering through a non-opaque embodiment of the guide.

In addition to garments such as shirts, the guide can be used with other garments such as pants or non-garment items such as bags or towels. Using the symmetry of such items, the sleeve alignment rule lines can be used to align the guide on both garments and non-garment items. Either by folding the symmetrical sides of the item over the guide or peering through a non-opaque embodiment of the guide, the symmetrical sides of the item can be aligned with corresponding sleeve alignment rule lines of each wing section, whether or not such items have sleeves. The sleeve alignment rule lines also help identify whether such items are straight on a heat press platen, and allows for such items to be straightened relative to the heat press platen.

Another embodiment of the sheet further includes co-linearly aligned sleeve alignment rule lines on opposing sides of the center line indicator which are each commonly demarked with indicia pairs such as letters or numbers and wherein adjacent sleeve alignment rule lines are uniquely demarked with an indicia sequence such as letters or numbers.

An embodiment of the sheet further includes a longitudinal slot formed therein on each side and substantially parallel to the center line indicator, whereby the heat-applied item may be placed under the guide and positioned relative to the guide and garment by manual manipulation thereof through one or both of the slots. Another embodiment of the sheet further includes a plurality of lateral slots formed therein on each side of and the center line indicator, with each lateral slot intersecting one of the longitudinal slots. Including intersecting longitudinal and lateral slots allows a user to position the heat-applied item on the garment quickly and accurately, without having to remove the guide.

Another feature of the guide includes a plurality of vertical offset spacers fixed to the bottom surface of the sheet, such that a gap is formed between the guide and the garment for facilitating movement of the heat-applied item therebetween. In one embodiment of the guide, the offset spacers can be fixed to the bottom surface of the sheet by a user of the guide, which allows the user to position the offset spacers based on the size of a user's heat press platen.

In use, a guide, as described above, is provided. A garment, such as a shirt, or a nonwearable item, laying flat on a surface is positioned at a desired location. A heat-applied item is placed on the garment. The guide is positioned at a desired location on the garment and on the heat-applied item by moving the guide relative thereto, with the garment and the heat-applied item remaining stationary. The heat-applied item is positioned at a desired location on the garment by manually moving the heat-applied item through the longitudinal and lateral slots.

The present device is a guide that helps center and position heat-applied items to assure the accuracy of the application. The present invention further decreases the amount of time to produce a high quality application. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
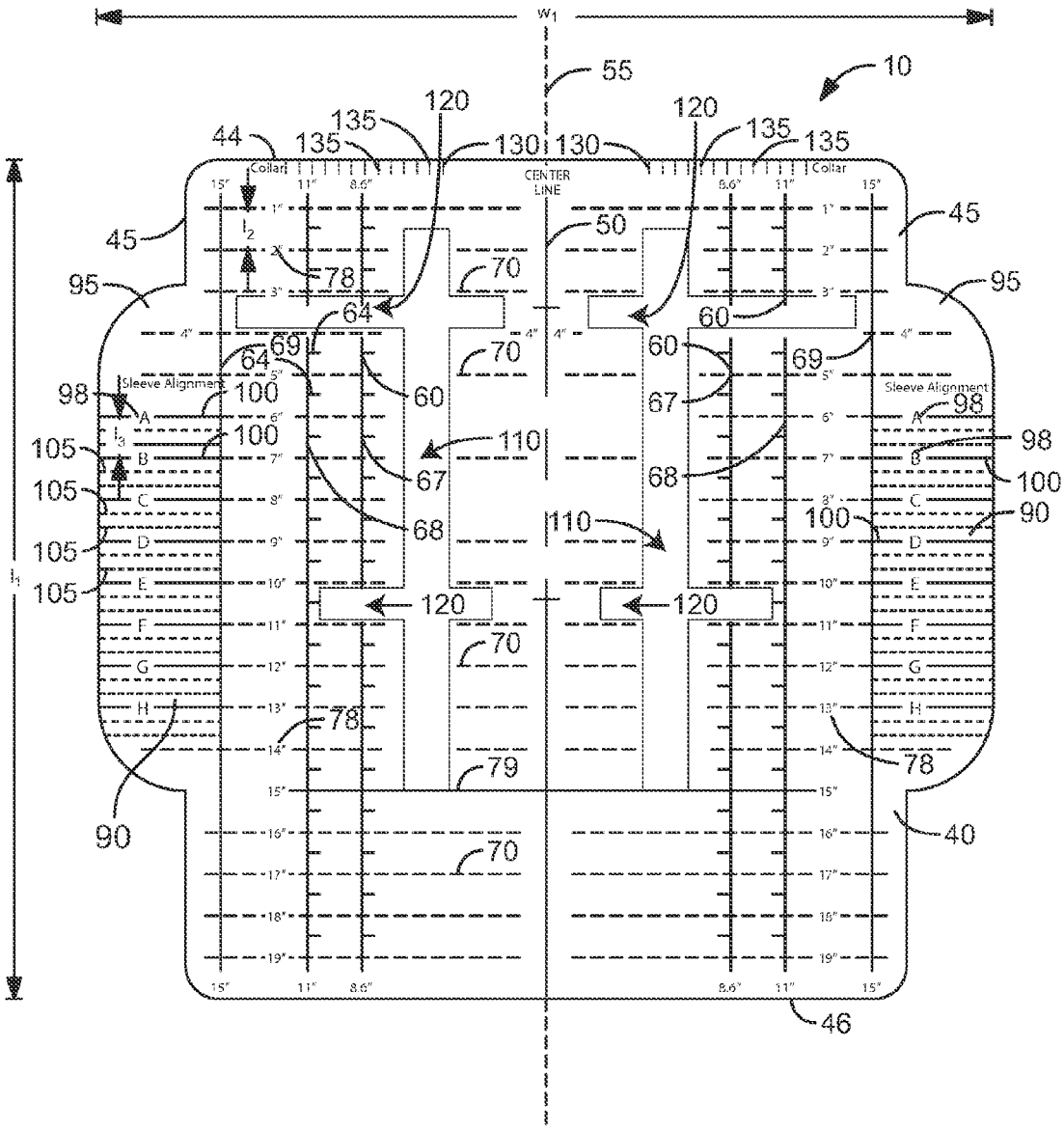
FIG. 1 is a front elevational view of the invention.
Figure 2A:
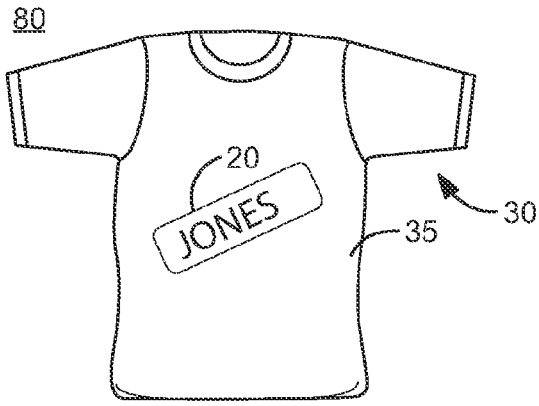
FIG. 2A is a top plan view of an un-aligned heat-applied item placed on a shirt.
Figure 2B:
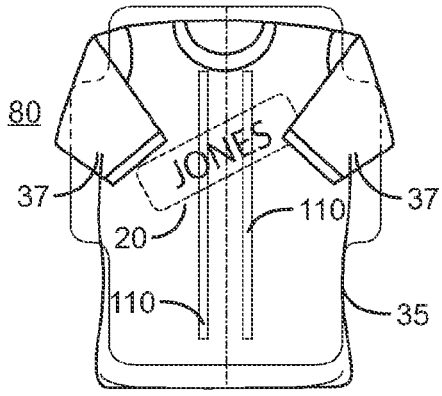
FIG. 2B is a top plan view of a guide placed on top of an un-aligned heat-applied item and shirt with the sleeves of the shirt folded over the guide.
Figure 2C:
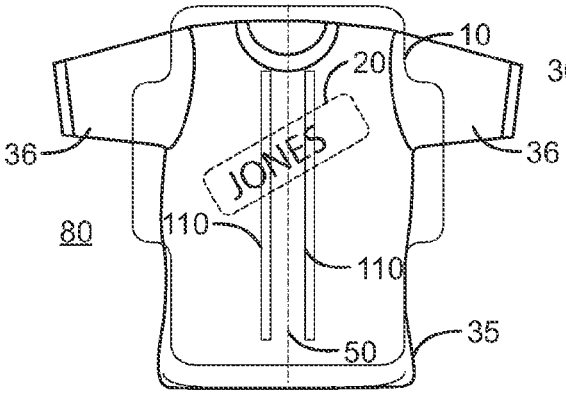
FIG. 2C is a top plan view of a guide placed on top of an un-aligned heat-applied item with a shirt on the bottom.
Figure 3:
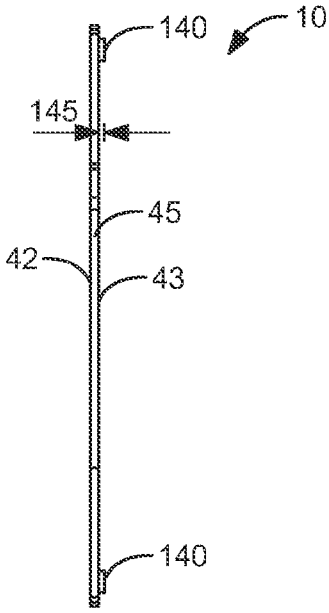
FIG. 3 is a right-side perspective view of the invention, illustrating the vertical offset spacers.

With respect to the drawings, FIG. 2C illustrates a guide 10 for positioning a heat-applied item 20 over a garment 30. In FIGS. 1 & 3, the guide 10 comprises a substantially flat sheet 40 having a top surface 42, a bottom surface 43, a front edge 44, a rear edge 46, and at least two side edges 45, the flat sheet 40 including a center line indicator 50 along a longitudinal axis 55 thereof, a plurality of longitudinal rule lines 60 symmetrically positioned on either side of the center line indicator 50 and substantially parallel thereto, and a plurality of lateral rule lines 70 extending between each side edge 45 and evenly spaced between the front and rear edges 44, 46.

One embodiment of the rule lines 60, 70 are applied to the top surface 42 of the guide 10. An alternate embodiment of the rule lines 60, 70 are applied to the bottom surface 43 of the sheet 40, the sheet 40 being made from a non-opaque material. The sheet 40 is preferably made from a light weight, non-opaque, and durable material such as a plastic material, preferably a polycarbonate material, but can also be formed from any suitable material, such as an acrylic or glass material, if desired.

Figure 2D:
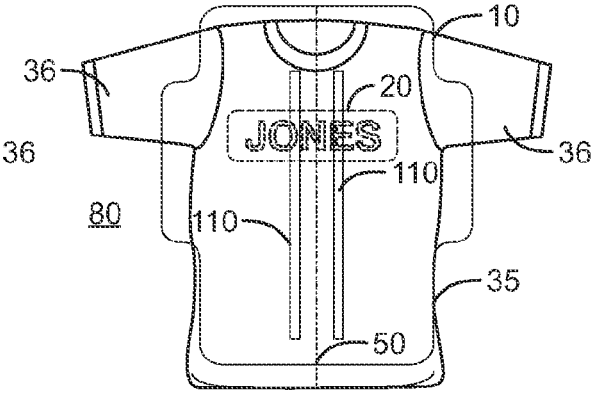
FIG. 2D is a top plan view of a guide placed on top of an aligned heat-applied item with a shirt on the bottom.

With the guide 10 placed over a garment 30 lying flat on a surface 80, the guide 10 may be moved relative to the garment 30 to position the guide 10 on the garment 30, the guide 10 indicating proper placement of the heat-applied item 20 on the garment 30, as illustrated in FIGS. 2C & 2D.

Width and Length

FIG. 1 illustrates a preferred embodiment of the width $w_1$ of the sheet 40 between side edges 45 of each wing section 90 is substantially the same length $l_1$ of the sheet 40 between the front and rear edges 44, 46. Preferably, both width $w_1$ and length $l_1$ are between 16 and 24 inches.

Lateral Rule Lines

FIG. 1 illustrates one embodiment of the guide 10 includes lateral rule lines 70 each spaced substantially one inch apart $l_2$. Another embodiment of the lateral rule lines 70 include non-solid rule lines 64 each spaced substantially one-half inch apart from each of the lateral rule lines 70. A further embodiment of the guide 10 includes lateral rule lines 70 with distance indicators 78 from the front edge 44 of the guide 10, preferably in whole inches. A preferred embodiment of the guide 10 includes at least one of the lateral rule lines 79 substantially 15 inches away from the front edge 44 of the guide 10, centered on the center line indicator 50, and distinctly marked, whereby the guide 10 may be readily centered on a standard 15-inch wide heat press platen.

Longitudinal Rule Lines

In one embodiment (FIG. 1), at least two of the longitudinal rule lines 67 are located substantially 4.25 inches on either side of the center line indicator 50 and distinctly marked, whereby a heat-applied item 20 that is 8.5 inches wide may be readily centered on the guide 10 thereby. In another embodiment (FIG. 1), at least two of the longitudinal rule lines 68 are located substantially 5.5 inches on either side of the center line indicator 50 and distinctly marked, whereby a heat-applied item 20 that is 11 inches wide may be readily centered on the guide 10 thereby. In one more embodiment (FIG. 1), at least two of the longitudinal rule lines 69 are located substantially 7.5 inches on either side of the center line indicator 50 and distinctly marked, whereby the guide 10 may be readily centered on a standard 15-inch wide heat press platen thereby.

Collar Alignment Rule Lines

As illustrated in FIG. 1, at least one pair of collar alignment rule lines 130 is proximate to the front edge 44 of the guide 10, substantially parallel to the center line indicator 50, and symmetrically positioned about the center line indicator 50. One embodiment of the guide 10 includes additional pairs of collar alignment rule lines 135 each being distinct in appearance from each adjacent pair of collar alignment rule lines 130.

Sleeve Alignment Rule Lines

As seen in FIG. 1, one embodiment of the sheet 40 further includes two wing sections 90 projecting from each side of the sheet 40. A preferred embodiment of the sheet 40 includes rounded corners 95 of the wing sections 90 (FIG. 1). The wing sections 90 include a plurality of sleeve alignment rule lines 100 spaced evenly there along and substantially perpendicular to the center line indicator 50. In FIGS. 2A & 2B, with the guide 10 positioned on the garment 30, the garment 30 being a shirt 35, for example, each of two sleeves 36 of the shirt 35 may be folded over the guide 10, and an edge of each sleeve 37 may be pulled tight to be aligned with corresponding sleeve alignment rule lines 100 of each wing section 90, the guide 10 thereby being properly positioned and square on the shirt 35. On smaller garments the sleeves 36 do not have to fold over the guide 10. Instead, both sleeves 36 may lay flat on the surface 80 as the sleeves 36 are aligned with corresponding sleeve alignment rule lines 100 by peering through a non-opaque embodiment of the guide 10.

In addition to garments such as shirts, the guide 10 can be used with other garments such as pants or non-garment items such as bags or towels. Using the symmetry of such items, the sleeve alignment rule lines 100 can be used to align the guide 10 on both garments and non-garment items. Either by folding the symmetrical sides of the item over the guide 10 or peering through a non-opaque embodiment of the guide 10, the symmetrical sides of the item can be aligned with corresponding sleeve alignment rule lines 100 of each wing section 90, whether or not such items have sleeves. The sleeve alignment rule lines 100 also help identify whether such items are straight on a heat press platen, and allows for such items to be straightened relative to the heat press platen.

In FIG. 1, a preferred embodiment of the sheet 40 includes each sleeve alignment rule line 100 spaced substantially one inch apart $l_3$, each corresponding to at least one of the lateral rule lines 70, and symmetrically-located about the center line indicator 50. Another embodiment of the sheet 40 further includes additional pairs of sleeve alignment rule lines 105 with each spaced substantially one-quarter inch from, and being distinct in appearance from, each adjacent pair of sleeve alignment rule lines 100. Another embodiment of the sheet 40 further includes co-linearly aligned sleeve alignment rule lines 100 on opposing sides of the center line indicator 50 which are each commonly demarked 98 with indicia pairs such as letters A,A or numbers 1,1 and wherein adjacent sleeve alignment rule lines 100 are uniquely demarked 98 with an indicia sequence such as letters A, B, C or numbers 1, 2, 3 (FIG. 1).

Slots

In FIGS. 1 & 2C., an embodiment of the sheet 40 further includes a longitudinal slot 110 formed therein on each side and substantially parallel to the center line indicator 50, whereby the heat-applied item 20 may be placed under the guide 10 and positioned relative to the guide 10 and garment 30 by manual manipulation thereof through one or both of the slots 110. Another embodiment of the sheet 40 further includes a plurality of lateral slots 120 formed therein on each side of and the center line indicator 50, with each lateral slot 120 intersecting one of the longitudinal slots 110 (FIG. 1). Including intersecting longitudinal and lateral slots 110, 120 allows a user to position the heat-applied item 20 on the garment 30 quickly and accurately, without having to remove the guide 10. In combination, the rule lines 60, 70 and slots 110, 120 on the guide 10 allow for accurate centering and spacing the heat-applied item 20 in a short period of time.

Spacers

As illustrated in FIG. 3, another feature of the guide 10 includes a plurality of vertical offset spacers 140 fixed to the bottom surface 43 of the sheet 40, such that a gap 145 is formed between the guide 10 and the garment 30 for facilitating movement of the heat-applied item 20 therebetween. In one embodiment of the guide 10, the offset spacers 140 can be fixed to the bottom surface 43 of the sheet 40 by a user of the guide 10, which allows the user to position the offset spacers 140 based on the size of a user's heat press platen.

In Use

In use, as illustrated in FIGS. 2A-2D, a guide 10, as described above, is provided. A garment 30 laying flat on a surface 80 is positioned at a desired location. A heat-applied item 20 is placed on the garment 30. The guide 10 is positioned at a desired location on the garment 30 and on the heat-applied item 20 by moving the guide 10 relative thereto, with the garment 30 and the heat-applied item 20 remaining stationary. The heat-applied item 20 is positioned at a desired location on the garment 30 by manually moving the heat-applied item 20 through the longitudinal and lateral slots 110, 120.

In another use, as illustrated in FIGS. 2A-2D, a guide 10, as described above, is provided. A shirt 35 laying flat on a surface 80 is positioned at a desired location. A heat-applied item 20 is placed on the shirt 35. The guide 10 is positioned at a desired location on the shirt 35 and on the heat-applied item 20 by moving the guide 10 relative thereto, with the shirt 35 and the heat-applied item 20 remaining stationary. The heat-applied item 20 is positioned at a desired location on the shirt 35 by manually moving the heat-applied item 20 through the longitudinal and lateral slots 110, 120.

In use with a shirt 35, the guide 10 provides a three-point reference system that allows quick and easy alignment of the heat-applied item 20. The three-points are as follows: (1) the center of a shirt's collar 35; (2) the bottom of the one sleeve 36; and (3) the bottom of the other sleeve 36. The three-point reference system allows the heat-applied item 20 to be positioned straight and properly spaced on the shirt 35. The guide 10 allows easy identification of these three points on a shirt 35 using the sleeve alignment rule lines 100, collar alignment rule lines 130, and the center line indicator 50.

In another use, as illustrated in FIGS. 2A-2D, a guide 10, as described above, is provided. A nonwearable item laying flat on a surface 80 is positioned at a desired location. A heat-applied item 20 is placed on the nonwearable item. The guide 10 is positioned at a desired location on the nonwearable item and on the heat-applied item 20 by moving the guide 10 relative thereto, with the nonwearable item and the heat-applied 20 item remaining stationary. The heat-applied item 20 is positioned at a desired location on the nonwearable item by manually moving the heat-applied item 20 through the longitudinal and lateral slots 110, 120.

While a particular form of the invention has been illustrated and described, it will be apparent that various modifications can be made without departing from the spirit and scope of the invention. For example, the corners of the guide 10 and wing sections 95 can be squared instead of rounded. The guide 10 may include only longitudinal slots 110 or only lateral slots 120. Also, a disposable version of the guide 10 may alternately be made by using a less durable material. Accordingly, it is not intended that the invention be limited, except as by the appended claims.

What is claimed is:

1. A guide for positioning a heat-applied item over a garment, the guide comprising a substantially flat sheet having a top surface, a bottom surface, a front edge, a rear edge, and at least two side edges, the flat sheet including a center line indicator along a longitudinal axis thereof, a plurality of longitudinal rule lines symmetrically positioned about the center line indicator and substantially parallel thereto, and a plurality of lateral rule lines extending between each side edge and evenly spaced between the front and rear edges, whereby with the guide placed over a garment lying flat on a surface, the guide may be moved relative to the garment to position the guide on the garment, the guide indicating proper placement of the heat-applied item on the garment;

wherein the sheet further includes two wing sections projecting from each side of the sheet, the wing sections including a plurality of sleeve alignment rule lines spaced evenly there along and substantially perpendicular to the center line indicator, whereby with the guide positioned on the garment, the garment being a shirt, each of two sleeves of the shirt may be folded over the guide, and an edge of each sleeve may be pulled tight to be aligned corresponding sleeve alignment rule lines of each wing section, the guide thereby being properly positioned and square on the shirt.

2. The guide of claim 1 wherein the rule lines are applied to the top surface of the guide.

3. The guide of claim 1 wherein the rule lines are applied to the bottom surface of the sheet, the sheet being made from a non-opaque material.

4. The guide of claim 1 wherein the sheet further includes a longitudinal slot formed therein on each side and substantially parallel to the center line indicator, whereby the heat-applied item may be placed under the guide and positioned relative to the guide and garment by manual manipulation thereof through one or both of the slots.

5. A method of positioning a heat-applied item onto a garment, the method comprised of the following steps:

a) providing a guide as recited in claim 4;

b) positioning the garment laying flat at a desired location on a surface;

c) placing a heat-applied item on the garment;

d) positioning the guide at a desired location on the garment and the heat-applied item by moving the guide relative thereto, the garment and the heat-applied item remaining stationary; and e) positioning the heat-applied item at a desired location on the garment by manually moving the heat-applied item through the longitudinal and lateral slots.

6. A method of positioning a heat-applied item onto a shirt, the method comprised of the following steps:

a) providing a guide as recited in claim 4;

b) positioning the shirt laying flat on a surface;

c) placing a heat-applied item on the shirt;

d) positioning the guide at a desired location on the shirt and the heat-applied item by moving the guide relative thereto, the shirt and the heat-applied item remaining stationary; and e) positioning the heat-applied item at a desired location on the shirt by manually moving the heat-applied item through the longitudinal and lateral slots.

7. A method of positioning a heat-applied item onto a nonwearable item, the method comprised of the following steps:

a) providing a guide as recited in claim 4;

b) positioning the nonwearable item laying flat on a surface;

c) placing a heat-applied item on the nonwearable item;

d) positioning the guide at a desired location on the nonwearable item and the heat-applied item by moving the guide relative thereto, the nonwearable item and the heat-applied item remaining stationary; and e) positioning the heat-applied item at a desired location on the nonwearable item by manually moving the heat-applied item through the longitudinal and lateral slots.

8. The guide of claim 1 wherein the width of the sheet between side edges of each wing section is substantially the same length of the sheet between the front and rear edges.

9. The guide of claim 8 wherein the sheet is between 16 and 24 inches in both width and length.

10. The guide of claim 1 wherein the lateral rule lines are each spaced substantially one inch apart.

11. The guide of claim 10 further including non-solid rule lines each spaced substantially one-half inch apart from each of the lateral rule lines.

12. The guide of claim 1 wherein the sleeve alignment rule lines are each spaced substantially one inch apart, each correspond to at least one of the lateral rule lines, and symmetrically-located about the center line indicator.

13. The guide of claim 12 further including additional pairs of sleeve alignment rule lines each spaced substantially one-quarter inch from, and being distinct in appearance from, each adjacent pair of sleeve alignment rule lines.

14. The guide of claim 12 wherein said sleeve alignment rule lines that are symmetrically-located about the center line indicator are each commonly demarked, and wherein adjacent sleeve alignment rule lines are uniquely demarked.

15. The guide of claim 1 wherein at least two of the longitudinal rule lines are located substantially 4.25 inches from the center line indicator and distinctly marked, whereby a heat-applied item that is 8.5 inches wide may be readily centered on the guide.

16. The guide of claim 1 wherein at least two of the longitudinal rule lines are located substantially 5.5 inches of from the center line indicator and distinctly marked, whereby a heat-applied item that is 11 inches wide may be readily centered on the guide.

17. The guide of claim 1 wherein at least two of the longitudinal rule lines are located substantially 7.5 inches from the center line indicator and distinctly marked, whereby the guide may be readily centered on a standard 15-inch wide heat press platen.

18. The guide of claim 1 wherein at least one of the lateral rule lines is substantially 15 inches away from the front edge of the guide, centered on the center line indicator, and distinctly marked, whereby the guide may be readily centered on the standard 15-inch wide heat press platen.

19. The guide of claim 1 wherein the lateral rule lines include distance indicators from the front edge of the guide in whole inches.

20. A guide for positioning a heat-applied item over a garment, the guide comprising a substantially flat sheet having a top surface, a bottom surface, a front edge, a rear edge, and at least two side edges, the flat sheet including a center line indicator along a longitudinal axis thereof, a plurality of longitudinal rule lines symmetrically positioned about the center line indicator and substantially parallel thereto, a plurality of lateral rule lines extending between each side edge and evenly spaced between the front and rear edges, and at least one pair of collar alignment rule lines proximate the front edge of the guide, substantially parallel to the center line indicator, and symmetrically positioned about the center line indicator, whereby with the guide placed over a garment lying flat on a surface, the guide may be moved relative to the garment to position the guide on the garment, the guide indicating proper placement of the heat-applied item on the garment.

21. The guide of claim 20 further including additional pairs of collar alignment rule lines each being distinct in appearance from each adjacent pair of collar alignment rule lines.

22. A guide for positioning a heat-applied item over a garment, the guide comprising a substantially flat sheet having a top surface, a bottom surface, a front edge, a rear edge, at least two side edges, and a wing section projecting from each side of the sheet, each wing section including a plurality of sleeve alignment rule lines spaced evenly there along and substantially perpendicular to a longitudinal axis of the sheet;

whereby with the guide positioned on the garment, the garment being a shirt, each of two sleeves of the shirt may be folded over the guide, and an edge of each sleeve may be pulled tight to be aligned with corresponding sleeve alignment rule lines of each wing section, the guide thereby being properly positioned and square on the shirt.

23. A guide for positioning a heat-applied item over a garment, the guide comprising a substantially flat sheet having a top surface, a bottom surface, a front edge, a rear edge, and at least two side edges, the flat sheet including a plurality of rule lines adapted to indicate proper positioning of the heat-applied item on the garment, said plurality of rule lines including at least one pair of collar alignment rule lines proximate the front edge of the guide, substantially parallel to a longitudinal axis of the sheet, and symmetrically positioned about said longitudinal axis;

whereby with the guide placed over a garment lying flat on a surface, the guide may be moved relative to the garment to position the guide on the garment, the guide indicating proper placement of the heat-applied item on the garment.

* * * * *